US010037737B2

(12) United States Patent
Chen et al.

(10) Patent No.: US 10,037,737 B2
(45) Date of Patent: Jul. 31, 2018

(54) COMMON VOLTAGE ADJUSTMENT CIRCUIT, COMMON VOLTAGE ADJUSTMENT METHOD, DISPLAY PANEL AND DISPLAY DEVICE

(71) Applicants: BOE TECHNOLOGY GROUP CO., LTD., Beijing (CN); CHONGQING BOE OPTOELECTRONICS TECHNOLOGY CO., LTD., Chongqing (CN)

(72) Inventors: Shuai Chen, Beijing (CN); Zhi Zhang, Beijing (CN); Lijun Xiao, Beijing (CN); Yuanbo Zhang, Beijing (CN)

(73) Assignees: BOE TECHNOLOGY GROUP CO., LTD. (CN); CHONGQING BOE OPTOELECTRONICS TECHNOLOGY CO., LTD. (CN)

( * ) Notice: Subject to any disclaimer, the term of this patent is extended or adjusted under 35 U.S.C. 154(b) by 0 days.

(21) Appl. No.: 15/674,387

(22) Filed: Aug. 10, 2017

(65) Prior Publication Data

US 2018/0047357 A1 Feb. 15, 2018

(30) Foreign Application Priority Data

Aug. 15, 2016 (CN) ..... 2016 1 0670268

(51) Int. Cl.
*H03F 3/45* (2006.01)
*G09G 3/36* (2006.01)

(52) U.S. Cl.
CPC ..... *G09G 3/3655* (2013.01); *G09G 3/3696* (2013.01); *G09G 2310/0291* (2013.01); *G09G 2320/0204* (2013.01); *G09G 2320/0233* (2013.01); *G09G 2320/0247* (2013.01); *G09G 2330/021* (2013.01)

(58) Field of Classification Search
CPC ..... H03F 3/45
USPC ..... 330/253, 252, 260, 261
See application file for complete search history.

(56) References Cited

U.S. PATENT DOCUMENTS 9,124,188 B2 * 9/2015 Fang ..... H02M 3/33507
2013/0051090 A1 * 2/2013 Xie ..... H02M 1/4258 363/21.17
2013/0058137 A1 * 3/2013 Huang ..... H02M 3/33523 363/21.12

(Continued)

*Primary Examiner* — Henry Choe
(74) *Attorney, Agent, or Firm* — Brooks Kushman P.C.

(57) ABSTRACT

The present disclosure provides a common voltage adjustment circuit, a common voltage adjustment method, a display panel and a display device. The common voltage adjustment circuit includes: a filter unit; and a control unit configured to, at a compensation stage, enable a common voltage feedback line to be electrically disconnected from a second input end of a common voltage negative-feedback amplification unit and enable a reference common voltage output end to be electrically connected to the second input end of the common voltage negative-feedback amplification unit through the filter unit, and at a non-compensation stage, enable the common voltage feedback line to be electrically connected to the second input end of the common voltage negative-feedback amplification unit and enable the reference common voltage output end to be electrically disconnected from the second input end of the common voltage negative-feedback amplification unit.

20 Claims, 11 Drawing Sheets

(56) References Cited

U.S. PATENT DOCUMENTS

2014/0022824 A1* 1/2014 Huang ..... H02M 3/33523
363/21.12

* cited by examiner

COMMON VOLTAGE ADJUSTMENT CIRCUIT, COMMON VOLTAGE ADJUSTMENT METHOD, DISPLAY PANEL AND DISPLAY DEVICE

CROSS-REFERENCE TO RELATED APPLICATIONS

The present application claims priority to Chinese Patent Application No. 201610670268.5 filed on Aug. 15, 2016, which is incorporated herein by reference in its entirety.

TECHNICAL FIELD

The present disclosure relates to the field of common voltage adjustment technology, in particular to a common voltage adjustment circuit, a common voltage adjustment method, a display panel and a display device.

BACKGROUND

Currently, in order to reduce the manufacturing costs and achieve a narrow bezel, most display panels have adopted a Gate driver On Array (GOA) technology. However, for the display panels adopting this technology, common voltage lines (including a common voltage feedback line and a common voltage compensation line) are very close to clock signal lines, so the common voltages across the common voltage lines may be adversely affected by the coupling effect of clock signals. In addition, clock signals from the clock signal lines may serve as control input applied to a GOA unit, and have a very large amplitude (up to 30V), so the resultant ripple on the common voltage is large, and thereby horizontal stripes may be generated.

SUMMARY

A primary object of the present disclosure is to provide a common voltage adjustment circuit, a common voltage adjustment method, a display panel and a display device, so as to prevent the occurrence of horizontal stripes due to a coupling effect of a clock signal line on a common voltage line.

In an aspect, the present disclosure provides in some embodiments a common voltage adjustment circuit, including a reference common voltage output end and a common voltage negative-feedback amplification unit. A first input end of the common voltage negative-feedback amplification unit is connected to the reference common voltage output end, and an output end of the common voltage negative-feedback amplification unit is connected to a common voltage compensation line. The common voltage adjustment circuit further includes: a filter unit connected to the reference common voltage output end and the first input end of the common voltage negative-feedback amplification unit and configured to filter out a ripple on the reference common voltage from the reference common voltage output end; and a control unit connected to the filter unit, a common voltage feedback line and a second input end of the common voltage negative-feedback amplification unit, and configured to, at a compensation stage, enable the common voltage feedback line to be electrically disconnected from the second input end of the common voltage negative-feedback amplification unit and enable the reference common voltage output end to be electrically connected to the second input end of the common voltage negative-feedback amplification unit through the filter unit, and at a non-compensation stage, enable the common voltage feedback line to be electrically connected to the second input end of the common voltage negative-feedback amplification unit and enable the reference common voltage output end to be electrically disconnected from the second input end of the common voltage negative-feedback amplification unit. A starting time point of the compensation stage comprises at least one of: a time point of a rising edge of a clock signal from a clock signal line at a distance within a predetermined range from the common voltage feedback line and a time point of a falling edge of the clock signal. The compensation stage is maintained for a predetermined duration. The non-compensation stage is a stage other than the compensation stage.

In a possible embodiment of the present disclosure, the filter unit includes a filter capacitor.

In a possible embodiment of the present disclosure, the common voltage negative-feedback amplification unit includes a negative-feedback operational amplifier, a first resistor, a second resistor and a third resistor. The second resistor is connected between an inverting input end and an output end of the negative-feedback operational amplifier. The inverting input end of the negative-feedback operational amplifier is connected to a first end of the first resistor. A first end of the third resistor is connected to the reference common voltage output end, and a second end of the third resistor is connected to a non-inverting input end of the negative-feedback operational amplifier. A second end of the first resistor is connected to the control unit. The output end of the negative-feedback operational amplifier is connected to the common voltage compensation line.

In a possible embodiment of the present disclosure, the control unit includes: a pulse control signal generation module configured to generate a pulse control signal with a pulse width corresponding to the compensation stage; and a switching module connected to the pulse control signal generation module and configured to, under the control of the pulse control signal, at the compensation stage, enable the common voltage feedback line to be electrically disconnected from the second input end of the common voltage negative-feedback amplification unit and enable the reference common voltage output end to be electrically connected to the second input end of the common voltage negative-feedback amplification unit through the filter unit, and at the non-compensation stage, enable the common voltage feedback line to be electrically connected to the second input end of the common voltage negative-feedback amplification unit and enable the reference common voltage output end to be electrically disconnected from the second input end of the common voltage negative-feedback amplification unit.

In a possible embodiment of the present disclosure, the pulse control signal generation module includes a pulse signal generator.

In a possible embodiment of the present disclosure, the pulse control signal generation module is configured to, at the rising edge or the falling edge of the clock signal from the clock signal line, enable the pulse control signal to jump from a first level to a second level, maintained at the second level for a predetermined time period, jump from the second level to the first level and maintained at the first level until the rising edge or the falling edge of the clock signal from the clock signal line occurs again. The switching module is configured to, in the event that the pulse control signal is at the second level, enable the common voltage feedback line to be electrically disconnected from the second input end of the common voltage negative-feedback amplification unit, and enable the reference common voltage output end to be electrically connected to the second input end of the common voltage negative-feedback amplification unit. The switching module is further configured to, in the event that the pulse control signal is at the first level, enable the common voltage feedback line to be electrically connected to the second input end of the common voltage negative-feedback amplification unit and enable the reference common voltage output end to be electrically disconnected from the second input end of the common voltage negative-feedback amplification unit.

In a possible embodiment of the present disclosure, in the event that the first level is a high level, the second level is a low level, and in the event that the first level is a low level, the second level is a high level.

In a possible embodiment of the present disclosure, the common voltage adjustment circuit further includes a first capacitor. The switching module includes: a first switching transistor having a control end connected to an output end of the pulse control signal generation module, a first end connected to the common voltage feedback line through the first capacitor, and a second end connected to the inverting input end of the negative-feedback operational amplifier through the first resistor; and a second switching transistor having a control end connected to the output end of the pulse control signal generation module, a first end connected to the non-inverting input end of the negative-feedback operational amplifier through the filter unit, and a second end connected to the inverting input end of the negative-feedback operational amplifier through the first resistor.

In a possible embodiment of the present disclosure, in the event that there are 2N clock signal lines at the distance within the predetermined range from the common voltage feedback line and an $n^{th}$ clock signal from an $n^{th}$ clock signal line has a frequency identical to and a phase opposite to an $(N+n)^{th}$ clock signal from an $(N+n)^{th}$ clock signal line, the common voltage feedback line and the common voltage compensation line are arranged in the middle of the 2N clock signal lines. The $n^{th}$ clock signal line and the $(N+n)^{th}$ clock signal line are arranged at opposite sides of the common voltage feedback line respectively, and a distance between the $n^{th}$ clock signal line and the common voltage feedback line is equal to a distance between the $(N+n)^{th}$ clock signal line and the common voltage feedback line. N is a positive integer, and n is a positive integer less than or equal to N.

In another aspect, the present disclosure provides in some embodiments a common voltage adjustment method for the above-mentioned common voltage adjustment circuit, including: receiving, by the first input end of the common voltage negative-feedback amplification unit, the reference common voltage from the reference common voltage output end; under the control of the control unit, at the compensation stage, receiving, by the second input end of the common voltage negative-feedback amplification unit, a ripple on the reference common voltage filtered out by the filter unit, and at the non-compensation stage, receiving, by the second input end of the common voltage negative-feedback amplification unit, a signal from the common voltage feedback line; and outputting, by the output end of the common voltage negative-feedback amplification unit, a signal to the common voltage compensation line.

In yet another aspect, the present disclosure provides in some embodiments a display panel including a common voltage feedback line, a common voltage compensation line and the above-mentioned common voltage adjustment circuit.

In a possible embodiment of the present disclosure, the display panel further includes 2N clock signal lines. The 2N clock signal lines are located at a distance within a predetermined range from the common voltage feedback line and an $n^{th}$ clock signal from an $n^{th}$ clock signal line has a frequency identical to and a phase opposite to an $(N+n)^{th}$ clock signal from an $(N+n)^{th}$ clock signal line, the common voltage feedback line and the common voltage compensation line are arranged in the middle of the 2N clock signals. The $n^{th}$ clock signal line and the $(N+n)^{th}$ clock signal line are arranged at opposite sides of the common voltage feedback line respectively, and a distance between the $n^{th}$ clock signal line and the common voltage feedback line is equal to a distance between the $(N+n)^{th}$ clock signal line and the common voltage feedback line. N is a positive integer, and n is a positive integer less than or equal to N.

In still yet another aspect, the present disclosure provides in some embodiments a display device including the above-mentioned display panel.

According to the common voltage adjustment circuit, the common voltage adjustment method, the display panel and the display device in the embodiments of the present disclosure, at the rising edge or the falling edge of the clock signal from the clock signal line at the distance within the predetermined range from the common voltage feedback line, an input signal is applied by the reference common voltage output end, rather than the common voltage feedback line, to the common voltage negative-feedback amplification unit under the control of the control unit, so as to prevent the occurrence of a ripple on the common voltage and eliminate the coupling effect of the clock signal line on the common voltage line, thereby preventing the occurrence of horizontal stripes.

DETAILED DESCRIPTION OF THE EMBODIMENTS

The embodiments of present disclosure will be described hereinafter in a clear and complete manner in conjunction with the drawings. Apparently, the following embodiments are merely a part of, rather than all of, the embodiments of the present disclosure.

Figure 1:
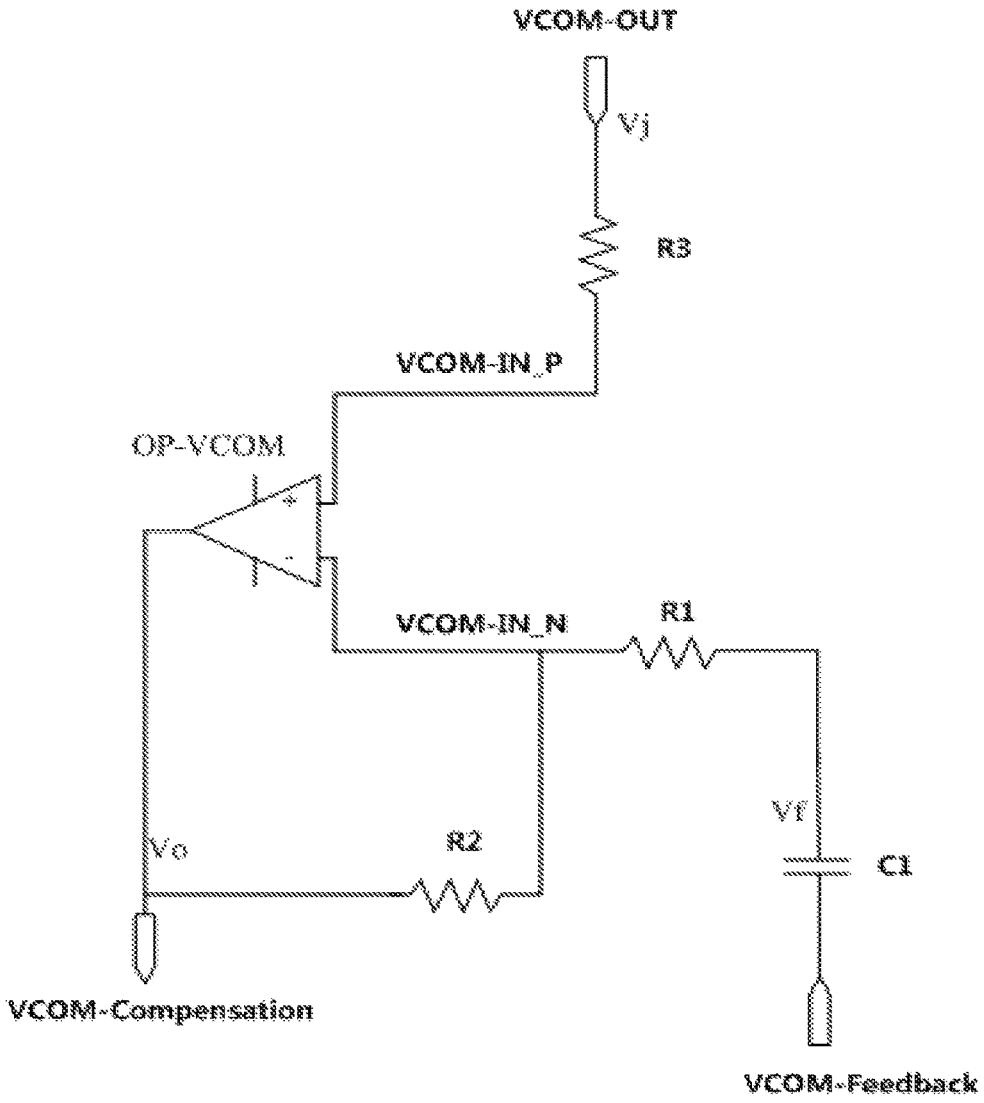
FIG. 1 is a circuit diagram of a common voltage adjustment circuit.

As shown in FIG. 1, a common voltage adjustment circuit includes a negative-feedback operational amplifier OP-VCOM, a first resistor R1, a second resistor R2, a third resistor R3 and a first capacitor. A non-inverting input end VCOM-IN_P of the negative-feedback operational amplifier is connected to a reference common voltage output end VCOM-OUT through the third resistor R3, and the reference common voltage output end VCOM-OUT is configured to output a reference common voltage Vj. An inverting input end VCOM-IN-N of the negative-feedback operational amplifier OP-VCOM is connected to a common voltage feedback line VCOM-Feedback through the first resistor R1 and the first capacitor C1. An output end of the negative-feedback operational amplifier OP-VCOM is connected to a common voltage compensation line VCOM-Compensation. The second resistor is connected between the inverting input end VCOM-IN_N and the output end of the negative-feedback operational amplifier OP-VCOM.

In FIG. 1, in the event that a common voltage feedback signal provided by the VCOM-Feedback, after passing through the first capacitor C1, has a fluctuation voltage Vf and an output voltage from the OP-VCOM is Vo, there is the following equation: $Vo=Vj-(R2/R1)*Vf$.

As can be seen from the above equation, in the event that a rising edge and/or a falling edge occurs in a clock signal from a clock signal line adjacent to a common voltage line (including the common voltage feedback line VCOM-Feedback and the common voltage compensation line VCOM-Compensation), the clock signal, as a control input voltage for a GOA unit, has a very large amplitude, so a ripple on a common voltage may be very large, i.e., a value of Vf may be very large. After being amplifier by the OP-VCOM, Vf may be applied to the common voltage compensation line. Therefore, the common voltage applied to a display panel may be adversely affected, and as a result, horizontal stripes may occur.

Figure 2:
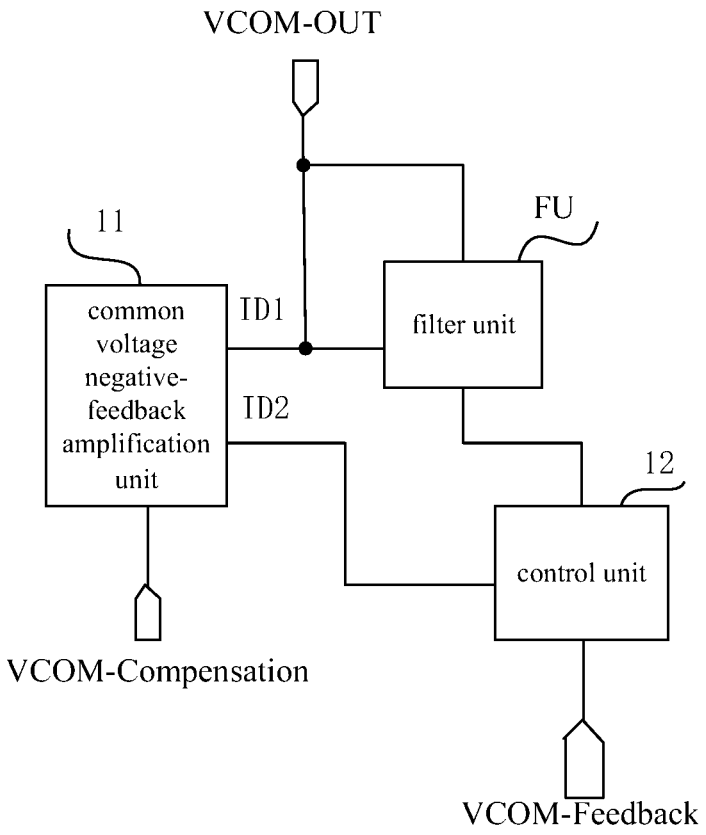
FIG. 2 is a block diagram of a common voltage adjustment circuit according to the embodiments of the present disclosure.

The present disclosure provides in some embodiments a common voltage adjustment circuit which, as shown in FIG. 2, includes a reference common voltage output end VCOM-OUT and a common voltage negative-feedback amplification unit 11. A first input end ID1 of the common voltage negative-feedback amplification unit 11 is connected to the reference common voltage output end VCOM-OUT, and an output end of the common voltage negative-feedback amplification unit 11 is connected to a common voltage compensation line VCOM-Compensation.

The common voltage adjustment circuit further includes: a filter unit FU connected to the reference common voltage output end VCOM-OUT and the first input end ID1 of the common voltage negative-feedback amplification unit and configured to filter out a ripple on the reference common voltage from the reference common voltage output end VCOM-OUT; and a control unit 12 connected to the filter unit FU, a common voltage feedback line VCOM-Feedback and a second input end ID2 of the common voltage negative-feedback amplification unit 11, and configured to, at a compensation stage, enable the common voltage feedback line VCOM-Feedback to be electrically disconnected from the second input end ID2 of the common voltage negative-feedback amplification unit 11 and enable the reference common voltage output end VCOM-OUT to be electrically connected to the second input end ID2 of the common voltage negative-feedback amplification unit 11 through the filter unit FU, and at a non-compensation stage, enable the common voltage feedback line VCOM-Feedback to be electrically connected to the second input end ID2 of the common voltage negative-feedback amplification unit 11 and enable the reference common voltage output end VCOM-OUT to be electrically disconnected from the second input end ID2 of the common voltage negative-feedback amplification unit 11. A starting time point of the compensation stage includes at least one of: a time point of a rising edge of a clock signal from a clock signal line at a distance within a predetermined range from the common voltage feedback line VCOM-Feedback is at a rising edge and a time point of a falling edge of the clock signal. The compensation stage is maintained for a predetermined duration. The non-compensation stage is a stage other than the compensation stage.

To be specific, the filter unit FU may include a filter capacitor.

In practical applications, the filter unit FU may merely include one filter capacitor, or may include any other element having a filtering function. A structure of the filter unit FU will not be particularly defined herein.

In practical applications, the first input end of the common voltage negative-feedback amplification unit may be a non-inverting input end of a negative-feedback operational amplifier included in the common voltage negative-feedback amplification unit, and the second input end of the common voltage negative-feedback amplification unit may be an inverting input end of the negative-feedback operational amplifier.

According to the common voltage adjustment circuit in the embodiments of the present disclosure, in the event that a rising edge or a falling edge occurs in a clock signal from a clock signal line at a distance within a predetermined range from the common voltage feedback line VCOM-Feedback, an input signal is provided by the reference common voltage output end VCOM-OUT, rather than the common voltage feedback line VCOM-Feedback, to the common voltage negative-feedback amplification unit 11 under the control of the control unit 12, so as to prevent the occurrence of a ripple on the common voltage and eliminate a coupling effect of the clock signal line on a common voltage line, thereby preventing the occurrence of horizontal stripes.

In the embodiments of the present disclosure, the common voltage line may include the common voltage feedback line VCOM-Feedback and the common voltage compensation line VCOM-Compensation, and the coupling effect is caused by the clock signal line on the common voltage feedback line VCOM-Feedback and the common voltage compensation line VCOM-Compensation, so there may be ripples on the common feedback voltage from the common voltage feedback line VCOM-Feedback and the common compensation voltage from the common voltage compensation line VCOM-Compensation. However, a fluctuating, alternating component from the common voltage feedback line VCOM-Feedback may be amplified through the common voltage negative-feedback amplification unit 11, and then the amplified output voltage may be applied to a common electrode through the common voltage compensation line VCOM-Compensation. Therefore, the ripple generated on the common voltage compensation line VCOM-Compensation due to the coupling effect of the clock signal line may not be amplified by the common voltage negative-feedback amplification unit, and thus may be omitted.

To be specific, the common voltage may be a common electrode voltage, or any other voltage which may fluctuate due to the coupling effect of the clock signal line.

In practical applications, the common voltage feedback line VCOM-Feedback and the common voltage compensation line VCOM-Compensation may be arranged on a display panel and adjacent to each other, and the common voltage compensation line VCOM-Compensation is configured to apply the common voltage to an electrode or terminal of the display panel.

In implementations, the reference common voltage output end VCOM-OUT is configured to output a direct-current (DC) voltage preset in accordance with the type of the display panel, and this DC voltage may also slightly fluctuate due to external influences.

Figure 3:
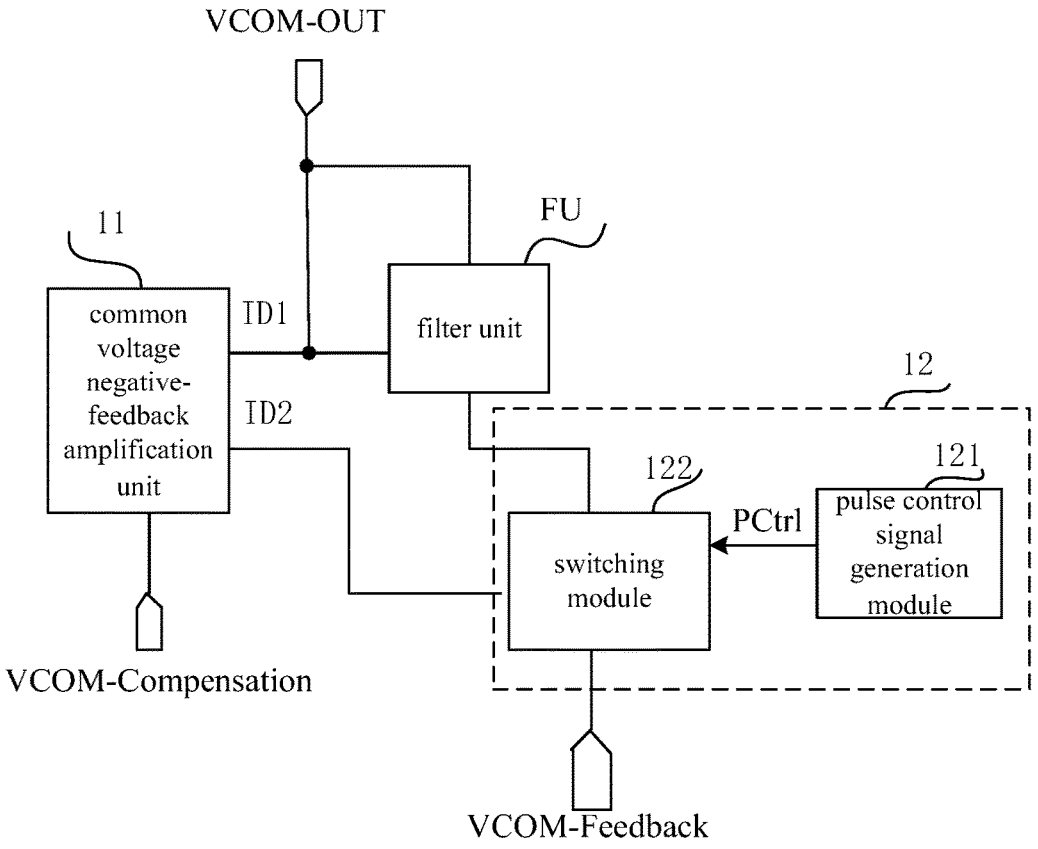
FIG. 3 is another block diagram of the common voltage adjustment circuit according to the embodiments of the present disclosure.

To be specific, as shown in FIG. 3, the control unit 12 includes: a pulse control signal generation module 121 configured to generate a pulse control signal PCtrl with a pulse width corresponding to the compensation stage; and a switching module 122 connected to the pulse control signal generation module 121 and configured to, under the control of the pulse control signal PCtrl, at the compensation stage, enable the common voltage feedback line VCOM-Feedback to be electrically disconnected from the second input end ID2 of the common voltage negative-feedback amplification unit 11 and enable the reference common voltage output end VCOM-OUT to be electrically connected to the second input end ID2 of the common voltage negative-feedback amplification unit 11 through the filter unit FU, and at the non-compensation stage, enable the common voltage feedback line VCOM-Feedback to be electrically connected to the second input end ID2 of the common voltage negative-feedback amplification unit 11 and enable the reference common voltage output end VCOM-OUT to be electrically disconnected from the second input end ID2 of the common voltage negative-feedback amplification unit 11.

In practical applications, the pulse control signal generation module 121 may include a pulse signal generator and an operational amplifier, and the pulse signal generator may be configured to generate the pulse control signal corresponding to the rising edge or the falling edge of the clock signal. However, the high level of the pulse control signal is too small to enable a switching transistor of the switching module 122 to be turned on, so the pulse control signal needs to be amplified by the operational amplifier, so as to turn on the corresponding switching transistor of the switching module 122 in a corresponding time period.

To be specific, the pulse control signal generation module may include a pulse signal generator.

To be specific, the pulse control signal generation module 121 is configured to, at the rising edge or falling edge of the clock signal from the clock signal line, enable the pulse control signal PCtrl to jump from a first level to a second level, maintained at the second level for a predetermined time period, jump from the second level to the first level, and maintained at the first level until the rising edge or the falling edge of the clock signal from the clock signal line occurs again. The switching module 122 is configured to, in the event that the pulse control signal PCtrl is at the second level, enable the common voltage feedback line VCOM-Feedback to be electrically disconnected from the second input end of the common voltage negative-feedback amplification unit 11, and enable the reference common voltage output end VCOM-OUT to be electrically connected to the second input end of the common voltage negative-feedback amplification unit 11. The switching module 122 is further configured to, in the event that the pulse control signal PCtrl is at the first level, enable the common voltage feedback line VCOM-Feedback to be electrically connected to the second input end of the common voltage negative-feedback amplification unit 11 and enable the reference common voltage output end VCOM-OUT to be electrically disconnected from the second input end of the common voltage negative-feedback amplification unit 11. In other words, in the event that the rising edge or the falling edge does not occur in the clock signal, no strong coupling effect may caused by the clock signal on the voltage from the common voltage feedback line VCOM-Feedback. Therefore, it is unnecessary to compensate for the common voltage compensation line by using the reference common voltage, and the common voltage feedback line VCOM-Feedback may be electrically connected to the second input end of the common voltage negative-feedback amplification unit 11 under the control of the switching module 122.

To be specific, in the event that the first level is a high level, the second level is a low level, and in the event that the first level is a low level, the second level is a high level.

The generation of the pulse control signal by the pulse control signal generation module 121 will be described hereinafter in accordance with a waveform diagram.

In the event that a first switching transistor of the switching module 122 is an n-type transistor and a second switching transistor of the switching module 122 is a p-type transistor, the first level is a low level and the second low level is a high level. In the event that the first switching transistor is a p-type transistor and the second switching transistor is an n-type transistor, the first level is a high level and the second level is a low level.

At the rising edge or the falling edge of the clock signal from the clock signal line, the pulse control signal generation module 121 is configured to enable the pulse control signal PCtrl to jump from a low level to a high level, maintained at the high level for a predetermined time period tp, jump from the high level to the low level and maintained at the low level until the rising edge or the falling edge of the clock signal from the clock signal line occurs again. In other words, the predetermined time period tp is the time period where the pulse control signal PCtrl is maintained at the high level. In practical applications, the length of the predetermined time period tp may be adjusted according to the actual requirements, as long as tp is shorter than an interval between the rising edges or the falling edges of two adjacent clock signals.

To be specific, the common voltage negative-feedback amplification unit 11 may include a negative-feedback operational amplifier, a first resistor, a second resistor and a third resistor. The second resistor is connected between an inverting input end and an output end of the negative-feedback operational amplifier. The inverting input end of the negative-feedback operational amplifier is connected to a first end of the first resistor. A first end of the third resistor is connected to the reference common voltage output end, and a second end of the third resistor is connected to a non-inverting input end of the negative-feedback operational amplifier. A second end of the first resistor is connected to the switching module. The output end of the negative-feedback operational amplifier is connected to the common voltage compensation line.

To be specific, the common voltage adjustment circuit further includes a first capacitor. The switching module includes: a first switching transistor, a control end of which is connected to an output end of the pulse control signal generation module, a first end of which is connected to the common voltage feedback line through the first capacitor, and a second end of which is connected to the inverting input end of the negative-feedback operational amplifier through the first resistor; and a second switching transistor, a control end of which is connected to the output end of the pulse control signal generation module, a first end of which is connected to the non-inverting input end of the negative-feedback operational amplifier through the filter unit, and a second end of which is connected to the inverting input end of the negative-feedback operational amplifier through the first resistor.

In practical applications, in the event that the transistor is a thin film transistor (TFT) or a metal-oxide-semiconductor (MOS) transistor, the control end may be a gate electrode, the first end may be a source or drain electrode, and the second end may be a drain or source electrode. In the event that the transistor is a triode, the control end may be a base, the first end may be an emitter or collector, and the second end may be a collector or emitter.

In practical applications, the first switching transistor may be of a type different from the second switching transistor. In other words, in the event that the first switching transistor is an n-type transistor, the second switching transistor may be a p-type transistor, and in the event that the first switching transistor is a p-type transistor, the second switching transistor may be an n-type transistor.

The common voltage adjustment circuit will be described hereinafter by way of an example.

Figure 4:
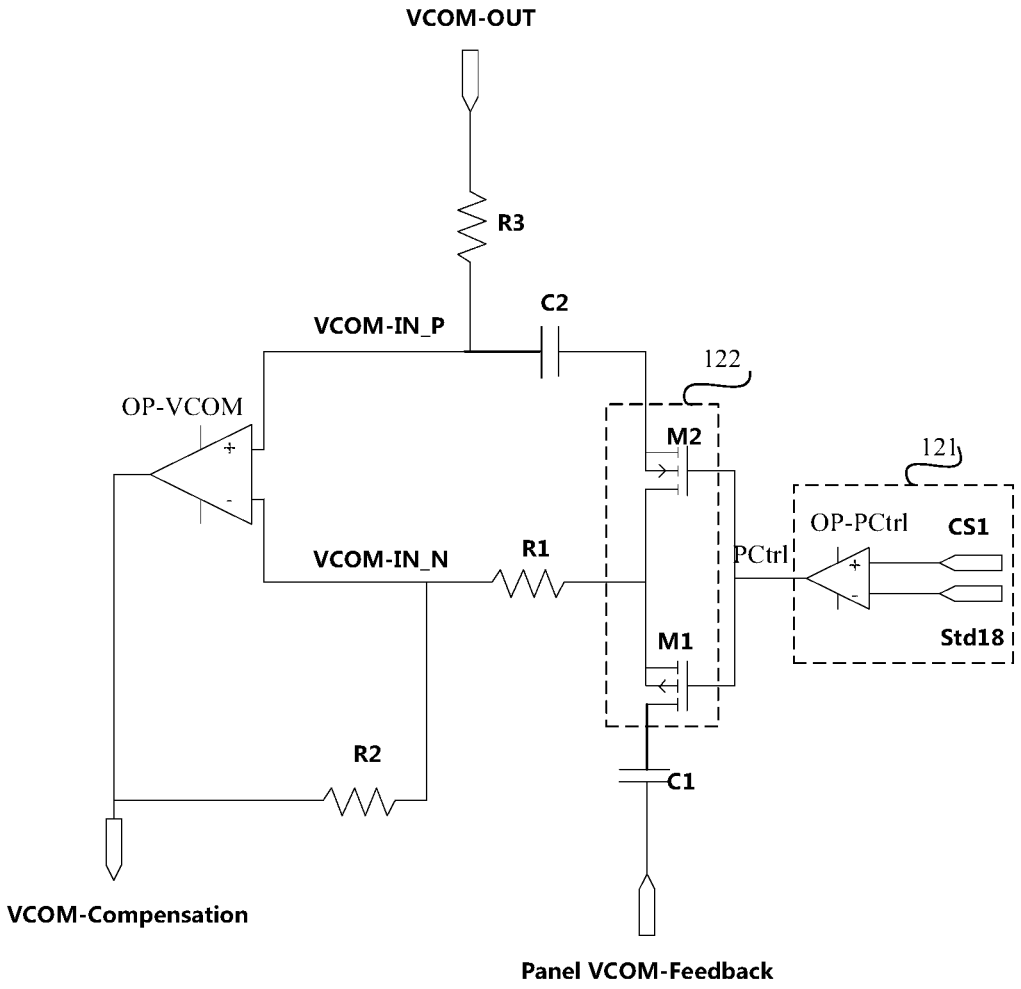
FIG. 4 is a circuit diagram of the common voltage adjustment circuit according to the embodiments of the present disclosure.

As shown in FIG. 4, the common voltage adjustment circuit may include the filter unit, the first capacitor C1, the common voltage negative-feedback amplification unit and the control unit. The filter unit includes a second capacitor C2. The control unit includes the pulse control signal generation module 121 configured to generate the pulse control signal PCtrl and the switching module 122 connected to the pulse control signal generation module 121.

The common voltage negative-feedback amplification unit includes the negative-feedback operational amplifier OP-VCOM, the first resistor R1, the second resistor R2 and the third resistor R3. The second resistor R2 is connected between the inverting input end VCOM-1N_N and the output end of the negative-feedback operational amplifier OP-VCOM. The inverting input end VCOM-INN of the negative-feedback operational amplifier OP-VCOM is connected to the first end of the first resistor R1, and the output end of the negative-feedback operational amplifier OP-VCOM is connected to the common voltage compensation line VCOM-Compensation.

The first end of the third resistor R3 is connected to the reference common voltage output end VCOM-OUT, and the second end thereof is connected to the non-inverting input end VCOM-IN_P of the negative-feedback operational amplifier OP-VCOM. The first end of the first resistor R1 is connected to the switching module 122. The non-inverting input end of VCOM-IN_P of the negative-feedback operational amplifier OP-VCOM is connected to the switching module 122 through the second capacitor C2.

The switching module 122 includes the first switching transistor M1 and the second switching transistor M2. The gate electrode of the first switching transistor M1 is connected to the output end of the pulse control signal generation module 121, the source electrode of the first switching transistor M1 is connected to the common voltage feedback line VCOM-Feedback through the first capacitor C1, and the drain electrode of the first switching transistor M1 is connected to the inverting input end VCOM-IN N of the negative-feedback operational amplifier OP-VCOM through the first resistor R1. The gate electrode of the second switching transistor M2 is connected to the output end of the pulse control signal generation module 121, the source electrode of the second switching transistor M2 is connected to the non-inverting input end VCOM-IN_P of the negative-feedback operational amplifier OP-VCOM through the first capacitor C1, and the drain electrode of the second switching transistor M2 is connected to the inverting input end VCOM-IN_N of the negative-feedback operational amplifier OP-VCOM through the first resistor R1.

The output end of the pulse control signal generation module 121 is configured to output the pulse control signal PCtrl. The pulse control signal generation module 121 includes the pulse signal generator (not shown in FIG. 4) configured to generate a pulse signal CS1 at the rising edge or the falling edge of the clock signal and the pulse operational amplifier OP-PCtrl configured to amplify the pulse signal CS1 so as to generate the pulse control signal PCtrl. A non-inverting input end of the pulse operational amplifier OP-PCtrl is configured to receive the pulse signal CS1, and an inverting input end of the pulse operational amplifier OP-PCtrl is configured to receive a DC voltage signal Std18 at a voltage of 1.8V.

As shown in FIG. 4, R3 is a resistor for the non-inverting inputend, and R1 and R2 are feedback resistors in the common voltage negative-feedback amplification unit. An amplification factor of the common voltage negative-feedback amplification unit may be changed by adjusting resistance of R1 and R2. Cl is a filter capacitor configured to collect an alternating component of a voltage signal from the VCOM-Feedback. C2 is configured to collect an alternating component of a voltage signal from the VCOM-OUT in the event that CS1 is at a high level. M1 is a p-type transistor, and M2 is an n-type transistor.

Figure 5A:
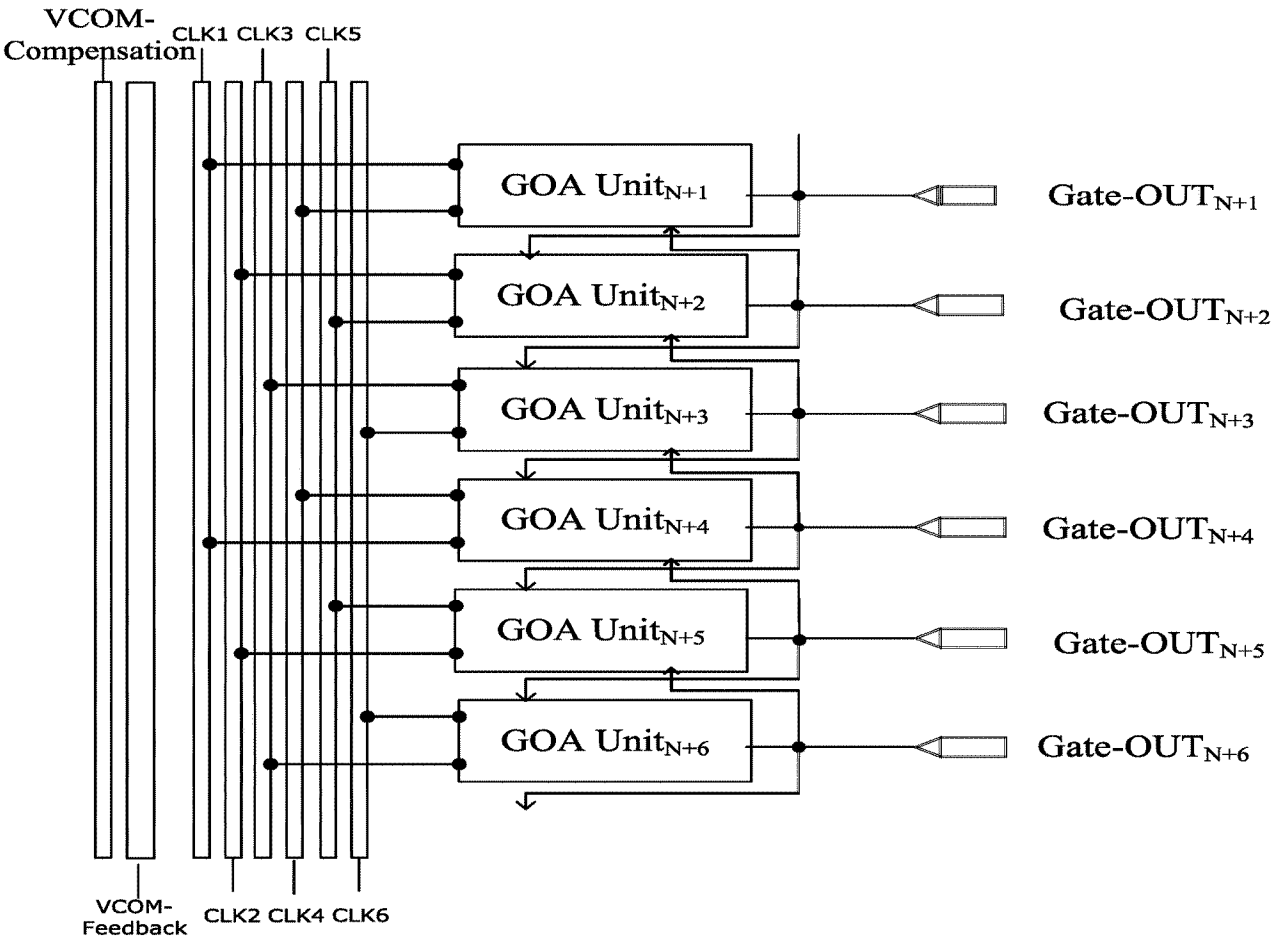
FIG. 5A is a schematic view showing the position relationship between common voltage lines and clock signal lines in the common voltage adjustment circuit according to the embodiments of the present disclosure.

As shown in FIG. 5A, for example, the common voltage feedback line VCOM-Feedback and the common voltage compensation line VCOM-Compensation are arranged at the left side of six clock signal lines. In practical applications, the number of the clock signal lines adjacent to the common voltage feedback line VCOM-Feedback and the common voltage compensation line VCOM-Compensation is not limited.

The six clock signal lines include, from left to right, a first clock signal line CLK1, a second clock signal line CLK2, a third clock signal line CLK3, a fourth clock signal line CLK4, a fifth clock signal line CLK5 and a sixth clock signal line CLK6.

In FIG. 5A, GOA UnitN+1 represents an $(N+1)^{th}$-stage GOA unit, GOA UnitN+2 is an $(N+2)^{th}$-stage GOA unit, GOA UnitN+3 is an $(N+3)^{th}$-stage GOA unit, GOA UnitN+4 is an $(N+4)^{th}$-stage GOA unit, GOA UnitN+5 is an $(N+5)^{th}$-stage GOA unit, GOA UnitN+6 is an $(N+6)^{th}$-stage GOA unit, Gate-OUTN+1 represents an $(N+1)^{th}$-stage gate driving signal, Gate-OUTN+2 represents an $(N+2)^{th}$-stage gate driving signal, Gate-OUTN+3 represents an $(N+3)^{th}$-stage gate driving signal, Gate-OUTN+4 represents an $(N+4)^{th}$-stage gate driving signal, Gate-OUTN+5 represents an $(N+5)^{th}$-stage gate driving signal, and Gate-OUTN+6 represents an $(N+6)^{th}$-stage gate driving signal, where N is a positive integer.

Figure 5B:
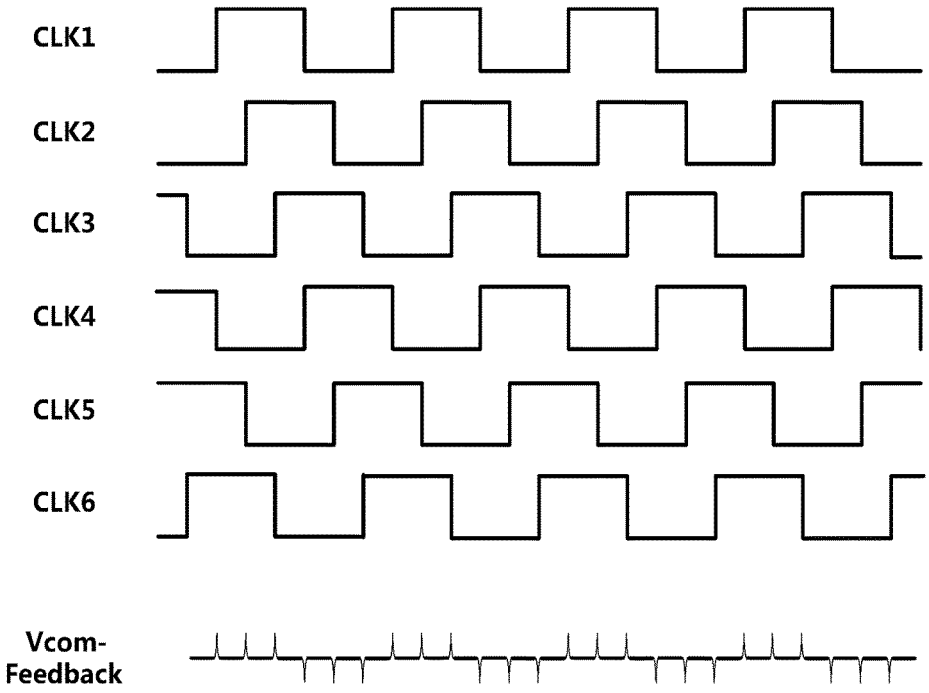
FIG. 5B is a waveform diagram of clock signals from the clock signal lines and a voltage from a common voltage feedback line VCOM-Feedback according to the embodiments of the present disclosure.

FIG. 5B shows a timing diagram of a first clock signal from the CLK1, a timing diagram of a second clock signal from the CLK2, a timing diagram of a third clock signal from the CLK3, a timing diagram of a fourth clock signal from the CLK4, a timing diagram of a fifth clock signal from the CLK5, a timing diagram of a sixth clock signal from the CLK6, and a waveform of a voltage from the common voltage feedback line VCOM-Feedback.

As shown in FIG. 5B, at the rising edge and the falling edge of each clock signal, there is a relatively large ripple on the voltage from the common voltage feedback line VCOM-Feedback. In the event that the voltage from the VCO M-Feedback is directly applied to the common voltage negative-feedback amplification unit without removing the ripple, the ripple may be amplified by the VCOM-OP and outputted to the common voltage compensation line VCOM-Compensation and then the display pane, resulting in the horizontal stripes.

The clock signal lines CLK1 to CLK6 are spaced apart from the common voltage line (including the common voltage feedback line VCOM-Feedback and the common voltage compensation line VCOM-Compensation) at different distances, so the coupling effects of the clock signal lines CLK1 to CLK6 on the common voltage line may be different from each other. The smaller the distance, the greater the coupling effect. Hence, the coupling effects of CLK1 to CLK3 on the common voltage line are larger than those of CLK4 to CLK6 on the common voltage line, resulting in three positive ripples and three negative ripples. These ripples may be amplified by the OP-VCOM and outputted to the display panel, resulting in three bright horizontal stripes and three dark horizontal stripes.

As shown in FIG. 5B, the rising edges of the first clock signal from the CLK1 coincide with the falling edges of the fourth clock signal from the CLK4, the falling edges of the first clock signal from the CLK1 coincide with the rising edges of the fourth clock signal from the CLK4, the rising edges of the second clock signal from the CLK2 coincide with the falling edges of the fifth clock signal from the CLK5, the falling edges of the second clock signal from the CLK2 coincide with the rising edges of the fifth clock signal from the CLK5, the rising edges of the third clock signal from the CLK3 coincide with the falling edges of the sixth clock signal from the CLK6, and the falling edges of the third clock signal from the CLK3 coincide with the rising edge of the sixth clock signal from the CLK6.

Figure 5C:
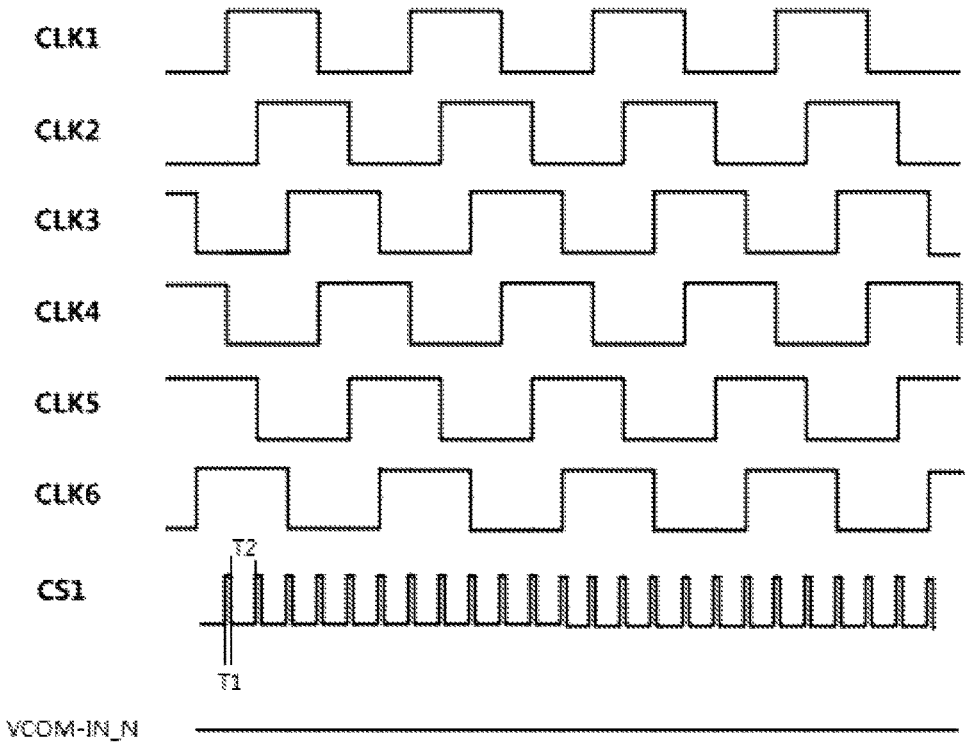
FIG. 5C is a sequence diagram of the common voltage adjustment circuit according to the embodiments of the present disclosure.
Figure 6A:
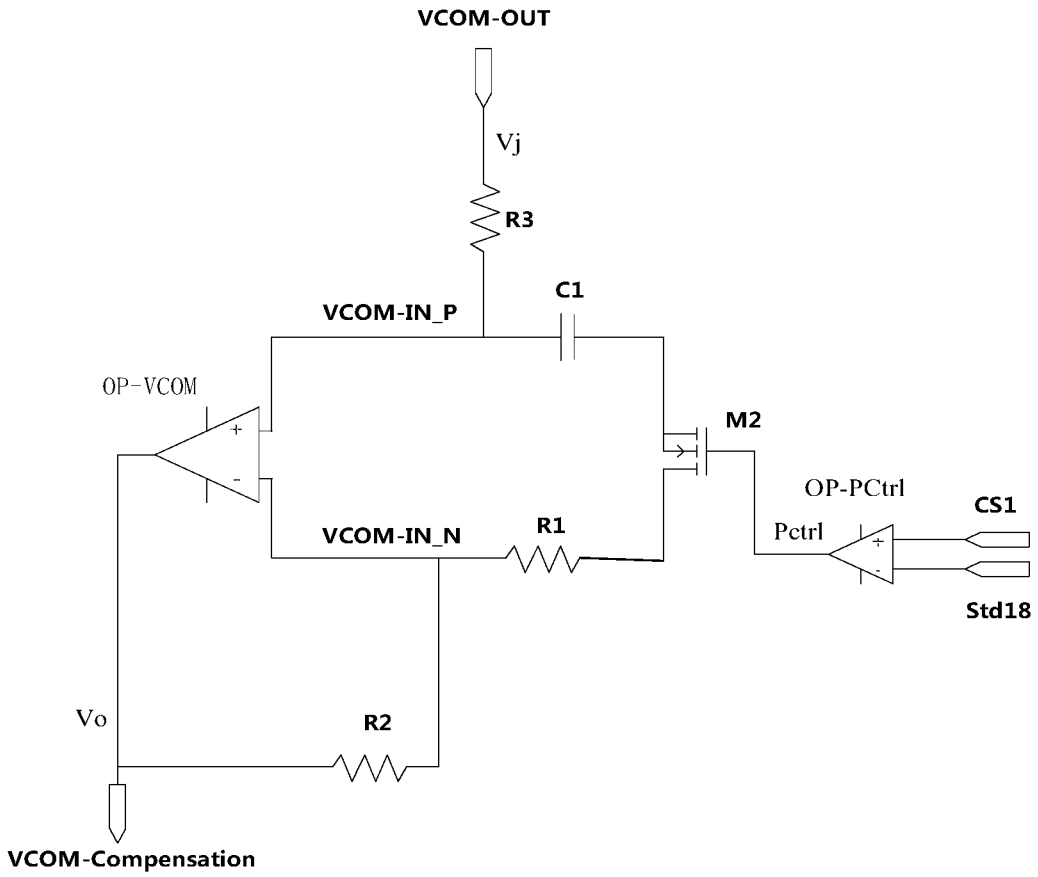
FIG. 6A is an equivalent circuit diagram of the common voltage adjustment circuit at a first stage T1 according to the embodiments of the present disclosure.

During the operation of the common voltage adjustment circuit in FIG. 4, as shown in FIG. 5C (which is a timing diagram of the common voltage adjustment circuit in FIG. 4), at a first stage T1 (the compensation stage), in the event that a rising edge occurs in the clock signal from any one of CLK1 to CLK6, CS1 is at a high level. As shown in FIG. 6A (which is an equivalent circuit diagram of the common voltage adjustment circuit in FIG. 4 at the first stage T1), M2 is turned on, and M1 is turned off. Because M1 is turned off, M1, C1 and VCOM-Feedback are not shown in FIG. 6A. At this time, a voltage signal from the VCOM-Feedback is blocked, and a reference common voltage signal from the VCOM-OUT is filtered by the second capacitor C2 and then outputted to the inverting input end VCOM-IN_N of the negative-feedback operational amplifier OP-VCOM. In FIG. 6A, VCOM-IN_P represents the non-inverting input end of the negative-feedback operational amplifier OP-VCOM.

Under this circumstance, there are the following two scenarios. In a first scenario, Vj is a DC voltage signal, and Vj is applied to the VCOM-IN_P through R3, and a signal applied to the VCOM-IN_N is 0V, so Vo=Vj. In a second scenario, Vj is a DC voltage signal interfered by a noise and has a value of Vj0+ΔVj, where Vj0 represents the DC voltage signal, and ΔVj represents an alternating ripple component of Vj interfered with the noise. Vj is applied to the VCOM-IN_P through R3, and ΔVj is applied to the VCOM-IN_N through R1. Accordingly, Vo=Vj−(R2/R1)*ΔVj.

Figure 6B:
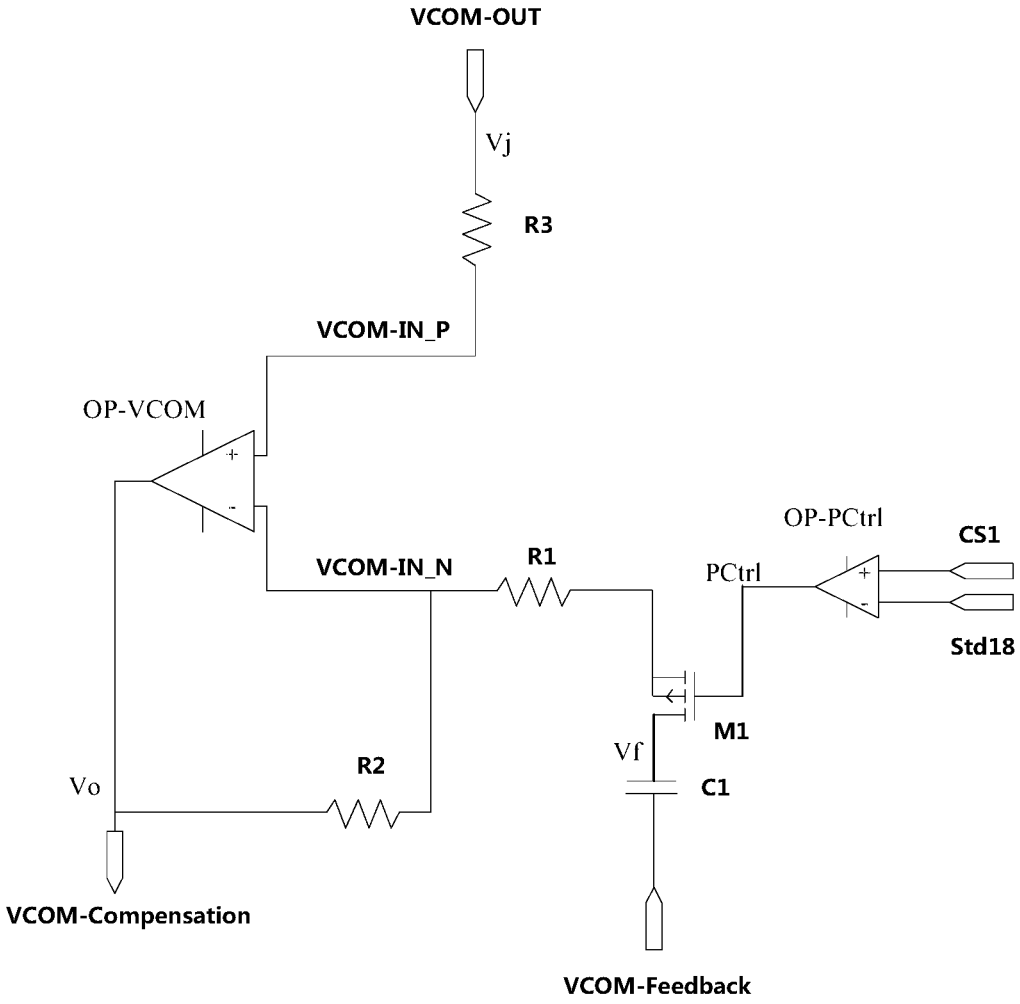
FIG. 6B is another equivalent circuit diagram of the common voltage adjustment circuit a second stage T2 according to the embodiments of the present disclosure.

At a second stage T2 (the non-compensation stage), CS1 is at a low level. As shown in FIG. 6B, M1 is turned on and M2 is turned off. Because M2 is turned off, M2 and C2 are not shown in FIG. 5B. a normal ripple voltage Vf in a common voltage feedback signal from the VCOM-Feedback is applied to the inverting input end VCOM-IN N of the negative-feedback operational amplifier OP-VCOM. At this time, Vo=Vj−(R2/R1)*Vf.

As shown in FIG. 5C, through the common voltage adjustment circuit in the embodiments of the present disclosure, there is no ripple on the voltage signal applied to the VCOM-IN_N.

In the embodiments of the present disclosure, the pulse signal generator Tcon is configured to output the pulse signal CS1 based on the clock signal, and the -ripple signal from the VCOM-Feedback is blocked at the rising edge and the falling edge of the clock signal, so as to remove the coupling effect of the clock signal line on the common voltage line, thereby preventing the occurrence of the horizontal stripes. The length of the time when the CS1 at a high level (i.e., a value of the predetermined time period tp) may be controlled by adjusting the pulse signal generator Tcon.

In a possible embodiment of the present disclosure, in the event that there are 2N clock signal lines at the distance within the predetermined range from the common voltage feedback line and an $n^{th}$ clock signal from an $n^{th}$ clock signal line has a frequency identical to and a phase opposite to an $(N+n)^{th}$ clock signal from an $(N+n)t^{h}$ clock signal line, the common voltage feedback line and the common voltage compensation line are arranged in the middle of the 2N clock signals. The $n^{th}$ clock signal line and the $(N+n)^{th}$ clock signal line are arranged at opposite sides of the common voltage feedback line respectively, and a distance between the $n^{th}$ clock signal line and the common voltage feedback line is equal to a distance between the $(N+n)^{th}$ clock signal line and the common voltage feedback line. N is a positive integer, and n is a positive integer less than or equal to N.

In a possible embodiment of the present disclosure, a value of a high level applied to the $n^{th}$ clock signal line is equal to a value of a high level applied to the $(N+n)^{th}$ clock signal line, and a value of a low level applied to the $n^{th}$ clock signal line is equal to a value of a low level applied to the $(N+n)^{th}$ clock signal line.

In other words, the common voltage feedback line may be arranged in the middle of the plurality of clock signal lines. In the event that the $n^{th}$ clock signal is arranged at a left side of the common voltage feedback line and the $(N+n)^{th}$ clock signal line is arranged at a right side of the common voltage feedback line, a rising edge of a waveform of the $n^{th}$ clock signal line at the left side of the common voltage feedback line corresponds to a falling edge of a waveform of the $(N+n)^{th}$ clock signal line at the right side of the common voltage feedback line, and a falling edge of the waveform of the $n^{th}$ clock signal line corresponds to a rising edge of the waveform of the $(N+n)^{th}$ clock signal line. In addition, a distance between the $n^{th}$ clock signal line and the common voltage feedback line is equal to a distance between the $(N+n)^{th}$ clock signal line and the common voltage feedback line. A value of a high level applied to the $n^{th}$ clock signal line is equal to a value of a high level applied to the $(N+n)^{th}$ clock signal line, and a value of a low level applied to the $n^{th}$ clock signal line is equal to a value of a low level applied to the $(N+n)^{th}$ clock signal line, so as to enable a coupling effect of the $n^{th}$ clock signal line on the common voltage feedback line to cancel out a coupling effect of the $(N+n)^{th}$ clock signal line on the common voltage feedback line, thereby preventing the occurrence of the horizontal stripes.

In practical applications, the common voltage compensation line may be arranged next to the common voltage feedback line, and it may also be arranged between the $n^{th}$ clock signal line and the $(N+n)^{th}$ clock signal line, so as to enable the coupling effect of the clock signal line at one side of the common voltage compensation line to cancel out the coupling effect of the clock signal line at the other side of the common voltage compensation line.

Figure 7:
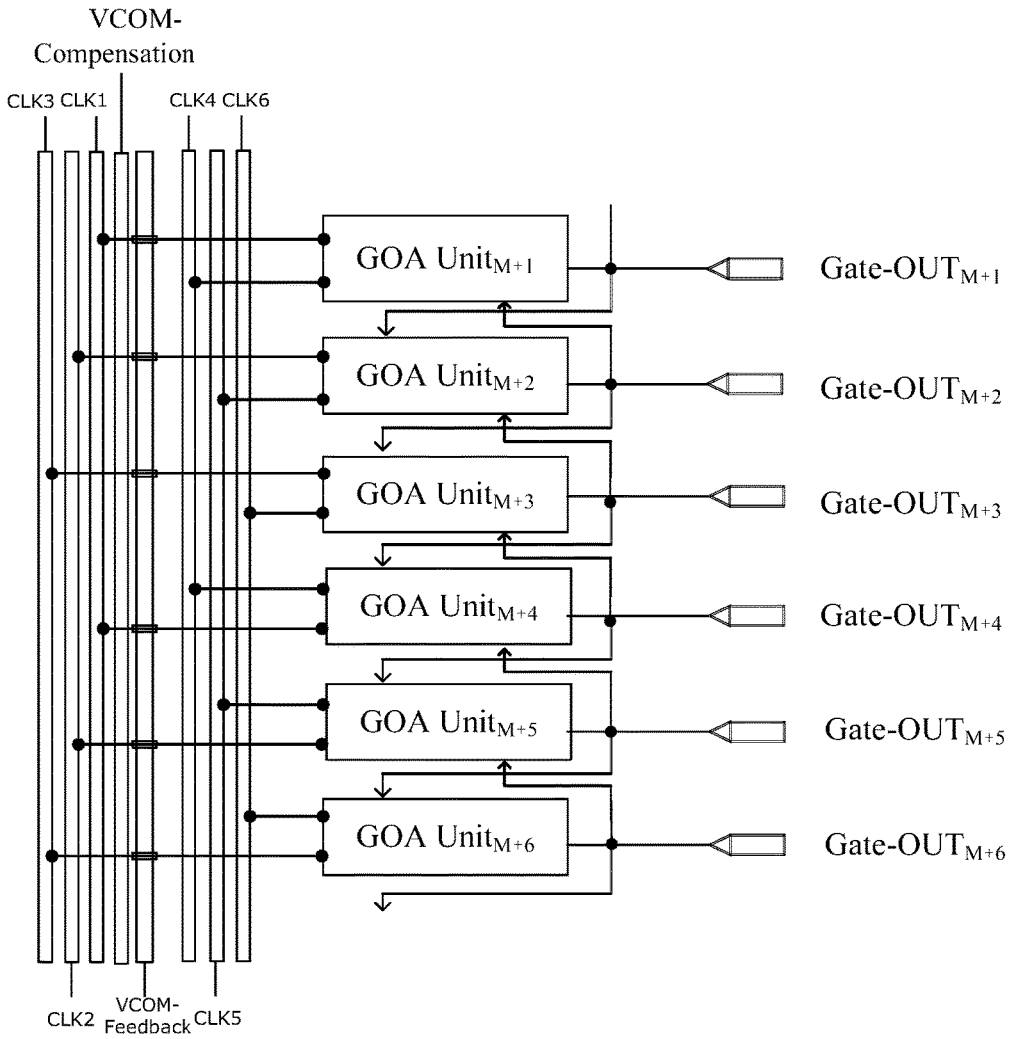
FIG. 7 is another schematic view showing the position relationship between the clock signal line and the common voltage line according to optional embodiments of the present disclosure.

As shown in FIG. 7, the first clock signal line CLK1, the second clock signal line CLK2 and the third clock signal line CLK3 are arranged at the left side of the common voltage feedback line VCOM-Feedback, and the fourth clock signal line CLK4, the fifth clock signal line CLK5 and the fifth clock signal line CLK6 are arranged at the right side of the common voltage feedback line VCOM-Feedback.

In FIG. 7, GOA UnitM+1 represents an $(M+1)^{th}$-stage GOA unit, GOA UnitM+2 represents an $(M+2)^{th}$-stage GOA unit, GOA UnitM+3 represents an $(M+3)^{th}$-stage GOA unit, GOA UnitM+4 represents an $(M+4)^{th}$-stage GOA unit, GOA UnitM+5 represents an $(M+5)^{th}$-stage GOA unit, GOA UnitM+6 represents an $(M+6)^{th}$-stage GOA unit, Gate-OUTM+1 represents an $(M+1)^{th}$-stage gate driving signal, Gate-OUTM+2 represents an $(M+2)^{th}$-stage gate driving signal, Gate-OUTM+3 represents an $(M+3)^{th}$-stage gate driving signal, Gate-OUTM+4 represents an $(M+4)^{th}$-stage gate driving signal, Gate-OUTM+5 represents an $(M+5)^{th}$-stage gate driving signal, and Gate-OUTM+6 represents an $(M+6)^{th}$-stage gate driving signal, where M is a positive integer.

As shown in FIG. 7, VCOM-Compensation may also be arranged in the middle of the clock signal lines and at one side of VCOM-Feedback.

Figure 8:
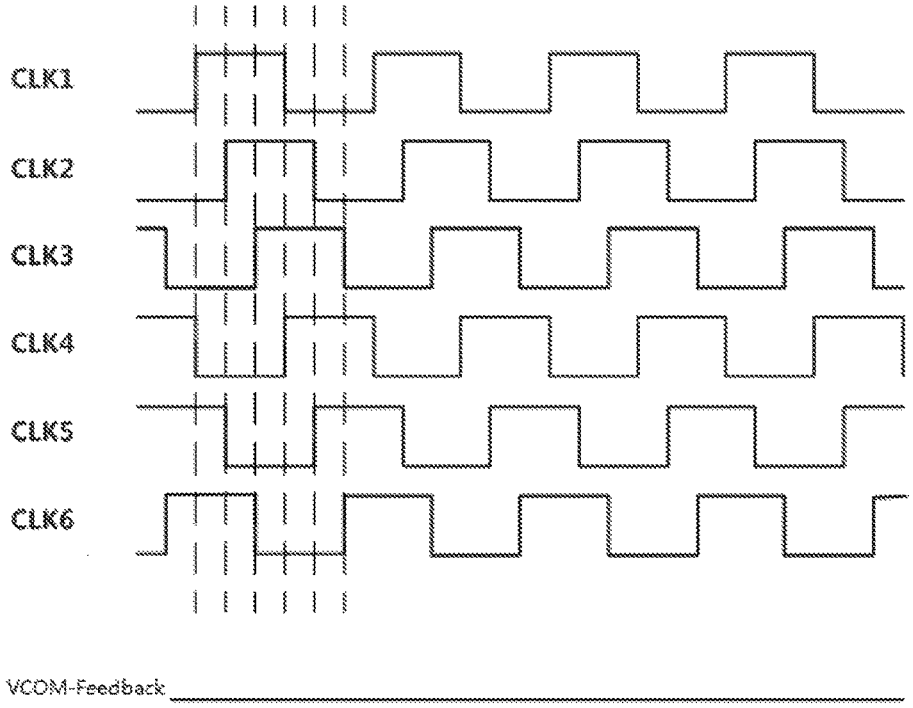
FIG. 8 is another waveform diagram of the clock signals from the clock signal lines and the voltage from the common voltage feedback line VCOM-Feedback in the common voltage adjustment circuit in FIG. 7.

As shown in FIG. 8, the rising edge of the first clock signal from CLK1 coincides with the falling edges of the fourth clock signal from CLK4, the falling edges of the first clock signal from CLK1 coincide with the rising edges of the fourth clock signal from CLK4, the rising edges of the second clock signal from CLK2 coincide with the falling edges of the fifth clock signal from CLK5, the falling edges of the second clock signal from CLK2 coincide with the rising edges of the fifth clock signal from CLK5, the rising edges of the third clock signal from CLK3 coincide with the falling edges of the sixth clock signal from CLK6, the falling edges of the third clock signal from CLK3 coincide with the rising edges of the sixth clock signal from CLK6, and a ripple on the voltage signal from the VCOM-Feedback is canceled out.

In the embodiment as shown in FIG. 7, a value of a high level of CLK1 needs to be equal to a value of a high level of CLK4, a value of a low level of CLK1 needs to be equal to a value of a low level of CLK4, a value of a high level of CLK2 needs to be equal to a value of a high level of CLK5, a value of a low level of CLK2 needs to be equal to a value of a low level of CLK5, a value of a high level of CLK3 needs to be equal to a value of a high level of CLK6, and a value of a low level of CLK3 needs to be equal to a value of a low level of CLK6.

The present disclosure further provides in some embodiments a common voltage adjustment method for the above-mentioned common voltage adjustment circuit. The method includes: receiving, by the first input end of the common voltage negative-feedback amplification unit, the reference common voltage from the reference common voltage output end; under the control of the control unit, at the compensation stage, receiving, by the second input end of the common voltage negative-feedback amplification unit, a ripple on the reference common voltage filtered out by the filter unit, and at the non-compensation stage, receiving, by the second input end of the common voltage negative-feedback amplification unit, a signal from the common voltage feedback line; and outputting, by the output end of the common voltage negative-feedback amplification unit, a signal to the common voltage compensation line.

According to the common voltage adjustment method in the embodiments of the present disclosure, at the compensation stage, the ripple on the reference common voltage from the reference common voltage output end, after passing through the filter unit, is applied to the second input end of the common voltage negative-feedback amplification unit under the control of the control unit. As a result, it is possible to remove the large ripple voltage of the common voltage feedback signal from the common voltage feedback line, prevent the fluctuating of the common voltage ripple and eliminate the coupling effect of the clock signal line on the common voltage line, thereby preventing the occurrence of the horizontal stripes.

To be specific, in the event that the control unit includes the pulse control signal generation module and the switching module, the step of receiving, by the second input end of the common voltage negative-feedback amplification unit, the ripple on the reference common voltage filtered by the filter unit at the compensation stage under the control of the control unit includes, at the compensation stage, within a predetermined time period starting from a time point of the rising edge or the falling edge of the clock signal from the clock signal line, i.e., the time point when the pulse control signal jump from the first level to the second level under the control of the pulse control signal generation module, maintaining, by the pulse control signal generation module, the pulse control signal at the second level, and receiving, by the second input end of the common voltage negative-feedback amplification unit, a ripple on the reference common voltage outputted from the reference common voltage output end and passing through the filter unit under the control of the pulse control signal and the switching module.

The step of receiving, by the second input end of the common voltage negative-feedback amplification unit, the signal from the common voltage feedback line at the non-compensation stage includes, at the non-compensation stage, within a time period starting from a time point when the pulse control signal, under the control of the pulse control signal generation module, jump from the second level to the first level and is maintained at the first level until the rising edge or the falling edge occurs in the clock signal from the clock signal line again, receiving, by the second input end of the common voltage negative-feedback amplification unit, a signal from the common voltage feedback line under the control of the pulse control signal and the switching module.

To be specific, in the event that the first level is a high level, the second level is a low level, or in the event that the first level is a low level, the second level is a high level.

The present disclosure further provides in some embodiments a display panel including a common voltage feedback line, a common voltage compensation line and the above-mentioned common voltage adjustment circuit.

In a possible embodiment of the present disclosure, the display panel further includes 2N clock signal lines. The 2N clock signal lines are located at a distance within a predetermined range from the common voltage feedback line and an nth clock signal from an $n^{th}$ clock signal line has a frequency identical to and a phase opposite to an (N+n)' clock signal from an $(N+n)^{th}$ clock signal line, the common voltage feedback line and the common voltage compensation line are arranged in the middle of the 2N clock signals. The $n^{th}$ clock signal line and the $(N+n)^{th}$ clock signal line are arranged at opposite sides of the common voltage feedback line respectively, and a distance between the nth clock signal line and the common voltage feedback line is equal to a distance between the $(N+n)^{th}$ clock signal line and the common voltage feedback line. N is a positive integer, and n is a positive integer less than or equal to N.

In a possible embodiment of the present disclosure, a value of a high level of the $n^{th}$ clock signal line is equal to a value of a high level of the $(N+n)^{th}$ clock signal line, and a value of a low level of the $n^{th}$ clock signal line is equal to a value of a low level of the $(N+n)^{th}$ clock signal line.

Figure 9:
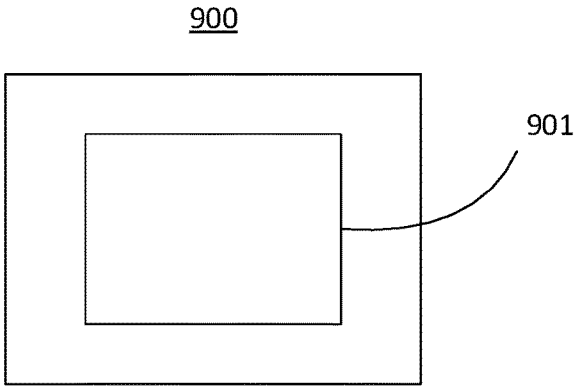
FIG. 9 is a schematic block diagram of a display device according to the embodiments of the present disclosure.

The present disclosure further provides in some embodiments a display device, which includes the above-mentioned display panel. As shown in FIG. 9, in a exemplary embodiment of the present application, a display device 900 includes the a display panel 901.

The above are merely optional embodiments of the present disclosure, and it should be noted by those skilled in the art that many improvements and modifications may be made to the present disclosure without departing from the principle of the present disclosure, and such improvements and modifications shall fall within the scope of the present disclosure..

What is claimed is:

1. A common voltage adjustment circuit, comprising a reference common voltage output end and a common voltage negative-feedback amplification unit, wherein a first input end of the common voltage negative-feedback amplification unit is connected to the reference common voltage output end, an output end of the common voltage negative-feedback amplification unit is connected to a common voltage compensation line, the common voltage adjustment circuit further comprises:

a filter unit connected to the reference common voltage output end and the first input end of the common voltage negative-feedback amplification unit, and configured to filter out a ripple on the reference common voltage from the reference common voltage output end; and a control unit connected to the filter unit, a common voltage feedback line and a second input end of the common voltage negative-feedback amplification unit, and configured to, at a compensation stage, enable the common voltage feedback line to be electrically disconnected from the second input end of the common voltage negative-feedback amplification unit and enable the reference common voltage output end to be electrically connected to the second input end of the common voltage negative-feedback amplification unit through the filter unit, and at a non-compensation stage, enable the common voltage feedback line to be electrically connected to the second input end of the common voltage negative-feedback amplification unit and enable the reference common voltage output end to be electrically disconnected from the second input end of the common voltage negative-feedback amplification unit, a starting time point of the compensation stage comprises at least one of: a time point of a rising edge of a clock signal from a clock signal line at a distance within a predetermined range from the common voltage feedback line and a time point of a falling edge of the clock signal, the compensation stage is maintained for a predetermined duration, and the non-compensation stage is a stage other than the compensation stage.

2. The common voltage adjustment circuit according to claim 1, wherein the filter unit comprises a filter capacitor.

3. The common voltage adjustment circuit according to claim 1, wherein the common voltage negative-feedback amplification unit comprises a negative-feedback operational amplifier, a first resistor, a second resistor and a third resistor;

the second resistor is connected between an inverting input end and an output end of the negative-feedback operational amplifier;

the inverting input end of the negative-feedback operational amplifier is connected to a first end of the first resistor;

a first end of the third resistor is connected to the reference common voltage output end, and a second end of the third resistor is connected to a non-inverting input end of the negative-feedback operational amplifier;

a second end of the first resistor is connected to the control unit; and the output end of the negative-feedback operational amplifier is connected to the common voltage compensation line.

4. The common voltage adjustment circuit according to claim 1, wherein the control unit comprises:

a pulse control signal generation module configured to generate a pulse control signal with a pulse width corresponding to the compensation stage; and a switching module connected to the pulse control signal generation module and configured to, under the control of the pulse control signal, at the compensation stage, enable the common voltage feedback line to be electrically disconnected from the second input end of the common voltage negative-feedback amplification unit and enable the reference common voltage output end to be electrically connected to the second input end of the common voltage negative-feedback amplification unit through the filter unit, and at the non-compensation stage, enable the common voltage feedback line to be electrically connected to the second input end of the common voltage negative-feedback amplification unit and enable the reference common voltage output end to be electrically disconnected from the second input end of the common voltage negative-feedback amplification unit.

5. The common voltage adjustment circuit according to claim 4, wherein the pulse control signal generation module comprises a pulse signal generator.

6. The common voltage adjustment circuit according to claim 4, wherein the pulse control signal generation module is configured to, at the rising edge or the falling edge of the clock signal from the clock signal line, enable the pulse control signal to jump from a first level to a second level, maintained at the second level for a predetermined time period, jump from the second level to the first level and maintained at the first level until the rising edge or the falling edge of the clock signal from the clock signal line occurs again;

the switching module is configured to, in the event that the pulse control signal is at the second level, enable the common voltage feedback line to be electrically disconnected from the second input end of the common voltage negative-feedback amplification unit, and enable the reference common voltage output end to be electrically connected to the second input end of the common voltage negative-feedback amplification unit; and the switching module is further configured to, in the event that the pulse control signal is at the first level, enable the common voltage feedback line to be electrically connected to the second input end of the common voltage negative-feedback amplification unit and enable the reference common voltage output end to be electrically disconnected from the second input end of the common voltage negative-feedback amplification unit.

7. The common voltage adjustment circuit according to claim 6, wherein in the event that the first level is a high level, the second level is a low level, and in the event that the first level is a low level, the second level is a high level.

8. The common voltage adjustment circuit according to claim 4, further comprising a first capacitor, wherein the switching module comprises:

a first switching transistor having a control end connected to an output end of the pulse control signal generation module, a first end connected to the common voltage feedback line through the first capacitor, and a second end connected to the inverting input end of the negative-feedback operational amplifier through the first resistor; and a second switching transistor having a control end connected to the output end of the pulse control signal generation module, a first end connected to the non-inverting input end of the negative-feedback operational amplifier through the filter unit, and a second end connected to the inverting input end of the negative-feedback operational amplifier through the first resistor.

9. The common voltage adjustment circuit according to claim 1, wherein in the event that there are 2N clock signal lines at the distance within the predetermined range from the common voltage feedback line and an $n^{th}$ clock signal from an $n^{th}$ clock signal line has a frequency identical to and a phase opposite to an $(NA^{-}n)^{th}$ clock signal from an $(N+n)^{th}$ clock signal line, the common voltage feedback line and the common voltage compensation line are arranged in the middle of the 2N clock signal lines;

the $n^{th}$ clock signal line and the $(N+n)^{th}$ clock signal line are arranged at opposite sides of the common voltage feedback line respectively, and a distance between the $n^{th}$ clock signal line and the common voltage feedback line is equal to a distance between the $(N+n)^{th}$ clock signal line and the common voltage feedback line;

wherein N is a positive integer, and n is a positive integer less than or equal to N.

10. The common voltage adjustment circuit according to claim 2, wherein the control unit comprises:

a pulse control signal generation module configured to generate a pulse control signal with a pulse width corresponding to the compensation stage; and a switching module connected to the pulse control signal generation module and configured to, under the control of the pulse control signal, at the compensation stage, enable the common voltage feedback line to be electrically disconnected from the second input end of the common voltage negative-feedback amplification unit and enable the reference common voltage output end to be electrically connected to the second input end of the common voltage negative-feedback amplification unit through the filter unit, and at the non-compensation stage, enable the common voltage feedback line to be electrically connected to the second input end of the common voltage negative-feedback amplification unit and enable the reference common voltage output end to be electrically disconnected from the second input end of the common voltage negative-feedback amplification unit.

11. The common voltage adjustment circuit according to claim 3, wherein the control unit comprises:

a pulse control signal generation module configured to generate a pulse control signal with a pulse width corresponding to the compensation stage; and a switching module connected to the pulse control signal generation module and configured to, under the control of the pulse control signal, at the compensation stage, enable the common voltage feedback line to be electrically disconnected from the second input end of the common voltage negative-feedback amplification unit and enable the reference common voltage output end to be electrically connected to the second input end of the common voltage negative-feedback amplification unit through the filter unit, and at the non-compensation stage, enable the common voltage feedback line to be electrically connected to the second input end of the common voltage negative-feedback amplification unit and enable the reference common voltage output end to be electrically disconnected from the second input end of the common voltage negative-feedback amplification unit.

12. The common voltage adjustment circuit according to claim 2, wherein in the event that there are 2N clock signal lines at the distance within the predetermined range from the common voltage feedback line and an $n^{th}$ clock signal from an $n^{th}$ clock signal line has a frequency identical to and a phase opposite to an $(N+n)^{th}$ clock signal from an $(N+n)^{th}$ clock signal line, the common voltage feedback line and the common voltage compensation line are arranged in the middle of the 2N clock signals;

the $n^{th}$ clock signal line and the $(N+n)^{th}$ clock signal line are arranged at opposite sides of the common voltage feedback line respectively, and a distance between the $n^{th}$ clock signal line and the common voltage feedback line is equal to a distance between the $(N+n)^{th}$ clock signal line and the common voltage feedback line;

wherein N is a positive integer, and n is a positive integer less than or equal to N.

13. The common voltage adjustment circuit according to claim 3, wherein in the event that there are 2N clock signal lines at the distance within the predetermined range from the common voltage feedback line and an $n^{th}$ clock signal from an $n^{th}$ clock signal line has a frequency identical to and a phase opposite to an $(N+n)^{th}$ clock signal from an $(N+n)^{th}$ clock signal line, the common voltage feedback line and the common voltage compensation line are arranged in the middle of the 2N clock signals;

the $n^{th}$ clock signal line and the $(N+n)^{th}$ clock signal line are arranged at opposite sides of the common voltage feedback line respectively, and a distance between the $n^{th}$ clock signal line and the common voltage feedback line is equal to a distance between the $(N+n)^{th}$ clock signal line and the common voltage feedback line;

wherein N is a positive integer, and n is a positive integer less than or equal to N.

14. A common voltage adjustment method for the common voltage adjustment circuit according to claim 1, comprising:

receiving, by the first input end of the common voltage negative-feedback amplification unit, the reference common voltage from the reference common voltage output end;

under the control of the control unit, at the compensation stage, receiving, by the second input end of the common voltage negative-feedback amplification unit, a ripple on the reference common voltage filtered out by the filter unit, and at the non-compensation stage, receiving, by the second input end of the common voltage negative-feedback amplification unit, a signal from the common voltage feedback line; and outputting, by the output end of the common voltage negative-feedback amplification unit, a signal to the common voltage compensation line.

15. A display panel, comprising a common voltage feedback line, a common voltage compensation line and the common voltage adjustment circuit according to claim 1.

16. The display panel according to claim 15, further comprising 2N clock signal lines, wherein the 2N clock signal lines are located at a distance within a predetermined range from the common voltage feedback line and an $n^{th}$ clock signal from an $n^{th}$ clock signal line has a frequency identical to and a phase opposite to an $(N+n)^{th}$ clock signal from an $(N+n)^{th}$ clock signal line, the common voltage feedback line and the common voltage compensation line are arranged in the middle of the 2N clock signal lines;

the $n^{th}$ clock signal line and the $(N+n)^{th}$ clock signal line are arranged at opposite sides of the common voltage feedback line respectively, and a distance between the $n^{th}$ clock signal line and the common voltage feedback line is equal to a distance between the $(N+n)^{th}$ clock signal line and the common voltage feedback line;

wherein N is a positive integer, and n is a positive integer less than or equal to N.

17. The display panel according to claim 15, wherein the filter unit comprises a filter capacitor.

18. The display panel according to claim 15, wherein the common voltage negative-feedback amplification unit comprises a negative-feedback operational amplifier, a first resistor, a second resistor and a third resistor;

the second resistor is connected between an inverting input end and an output end of the negative-feedback operational amplifier;

the inverting input end of the negative-feedback operational amplifier is connected to a first end of the first resistor;

a first end of the third resistor is connected to the reference common voltage output end, and a second end of the third resistor is connected to a non-inverting input end of the negative-feedback operational amplifier;

a second end of the first resistor is connected to the control unit; and the output end of the negative-feedback operational amplifier is connected to the common voltage compensation line.

19. A display device, comprising the display panel according to claim 15.

20. The display device according to claim 19, further comprising 2N clock signal lines, wherein the 2N clock signal lines are located at a distance within a predetermined range from the common voltage feedback line and an $n^{th}$ clock signal from an $n^{th}$ clock signal line has a frequency identical to and a phase opposite to an $(N+n)^{th}$ clock signal from an $(N+n)^{th}$ clock signal line, the common voltage feedback line and the common voltage compensation line are arranged in the middle of the 2N clock signal lines;

the $n^{th}$ clock signal line and the $(N+n)^{th}$ clock signal line are arranged at opposite sides of the common voltage feedback line respectively, and a distance between the $n^{th}$ clock signal line and the common voltage feedback line is equal to a distance between the $(N+n)^{th}$ clock signal line and the common voltage feedback line;

wherein N is a positive integer, and n is a positive integer less than or equal to N.

* * * * *